US005918335A

United States Patent [19]

Han

[11] Patent Number: 5,918,335

[45] Date of Patent: Jul. 6, 1999

[54] BABY PILLOW

[76] Inventor: Tien-Hsi Han, No. 92-21, Pu Tzu Tsuo, Pu Tai Chen, Chia Yi Hsien, Taiwan

[21] Appl. No.: 09/089,227

[22] Filed: Jun. 3, 1998

[51] Int. Cl.[6] ..... A47C 20/02

[52] U.S. Cl. ..... 5/655; 5/637; 5/643

[58] Field of Search ..... 5/655, 636, 637, 5/640, 643

[56] References Cited

U.S. PATENT DOCUMENTS

| | | | |
|---|---|---|---|
| 1,385,355 | 7/1921 | Banks . | |
| 1,540,685 | 6/1925 | Eiband . | |
| 1,694,547 | 12/1928 | Karr . | |
| 2,167,622 | 8/1939 | Bentivoglio . | |
| 5,115,528 | 5/1992 | Lamle | 5/640 |
| 5,572,753 | 11/1996 | Ruscitto | 5/636 X |
| 5,692,257 | 12/1997 | Albertieri | 5/655 |

*Primary Examiner*—Brian K. Green
*Assistant Examiner*—James Hewitt
*Attorney, Agent, or Firm*—Rosenberg, Klein & Bilker

[57] ABSTRACT

A baby pillow includes a base plate and two frames connected to two sides of the base plate. A cotton body surrounds each frame, and a layer of cotton cloth is made to cover the base plate and the two side cotton bodies. A soft cushion layer is formed with a cotton bag filled with cotton and then sewed with a side of the cotton cloth of the base plate, and then folded to overlap the base plate. The head of a baby may be laid on the soft cushion layer overlapped on the base plate, with the two side cotton bodies folded up to two sides of the head of the baby to help prevent the head from turning to a side, keeping it in a normal position, and preventing noise from reaching the ears of the baby to permit it to sleep soundly.

1 Claim, 3 Drawing Sheets

BABY PILLOW

BACKGROUND OF THE INVENTION

This invention relates to a baby pillow, particularly to one that makes it possible to correct the sleeping position of a baby, so as to prevent its head from turning to a side for a long period of time and from disfiguring caused by turning its head to a side.

A newly born baby generally has a very soft skull that is liable to become disfigured by sleeping with its head turned to a side for a long period of time. In addition, its head may be disfigured during delivery from its mother, and nurses in a hospital may be too busy to monitor the sleeping position of a baby, resulting in disfiguring of a baby's head or even of its face when the baby leaves the hospital and goes home. Then its mother would have to take measures to correct the shape of her baby's head before it hardens.

SUMMARY OF THE INVENTION

A purpose of the invention is to offer a baby pillow, which includes a base plate and two U-shaped flexible side frames, a cotton body disposed in a space surrounding each side frame. Then the base plate and the two side cotton bodies with the frames are wrapped with a cotton cloth to form a center pillow portion and a protective portion of a pillow, and a soft cushion layer is made with a cotton bag filled with cotton and sewn with a side of the cotton cloth of the base plate. Then the soft cushion layer is folded to overlap the center pillow portion, for the head of a baby to lie thereon. After that, the protective portion (the two side cotton bodies with the two side frames) is folded up to near two sides of the head of the baby, keeping the baby's head in a correct position and hampering the baby's head from turning to a side.

Another purpose of the invention is to reduce external noise that may be heard by a baby, with the two side portions being folded near the two sides of the head of a baby.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
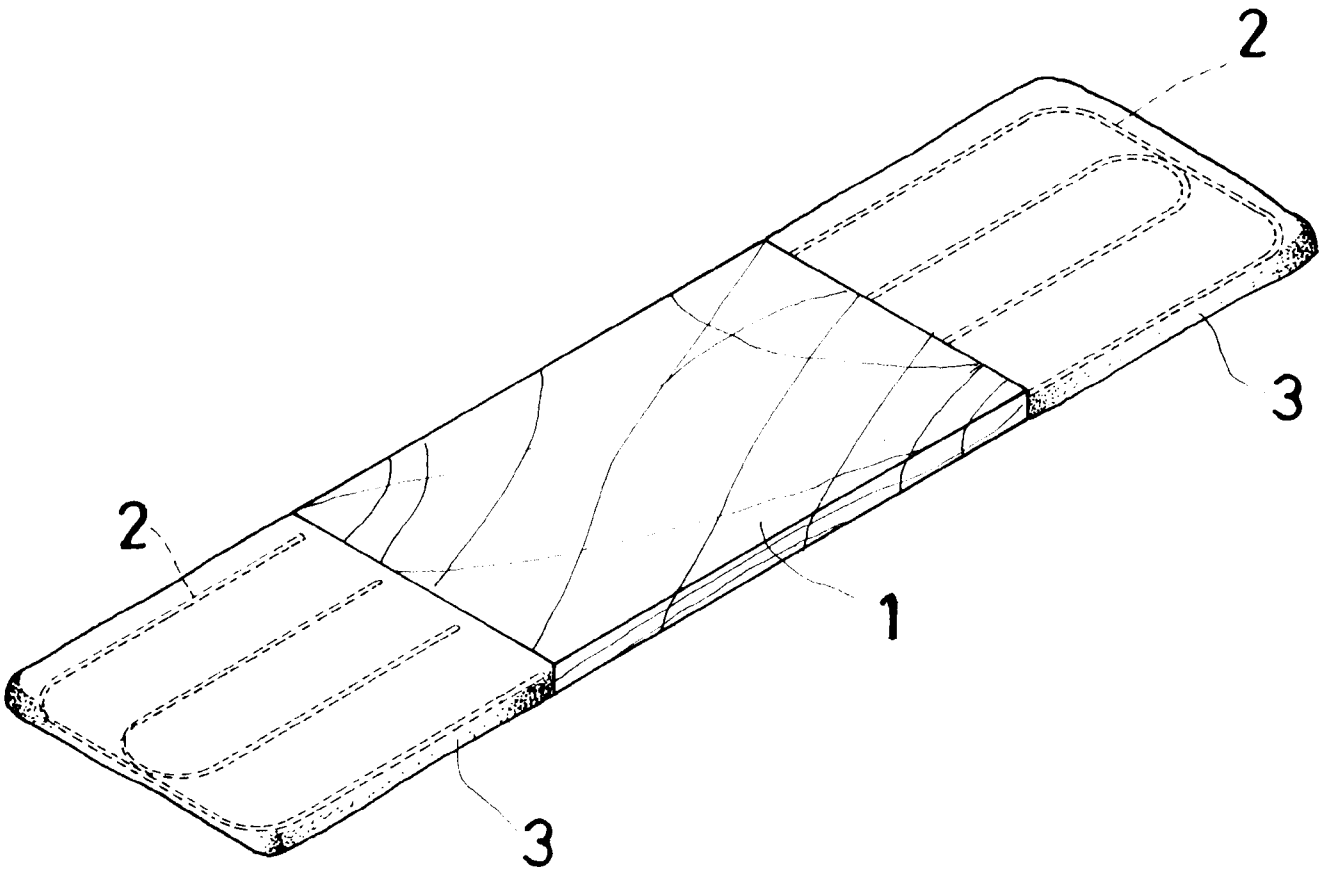
FIG. 1 is a perspective view of a baby pillow of the present invention.
Figure 2:
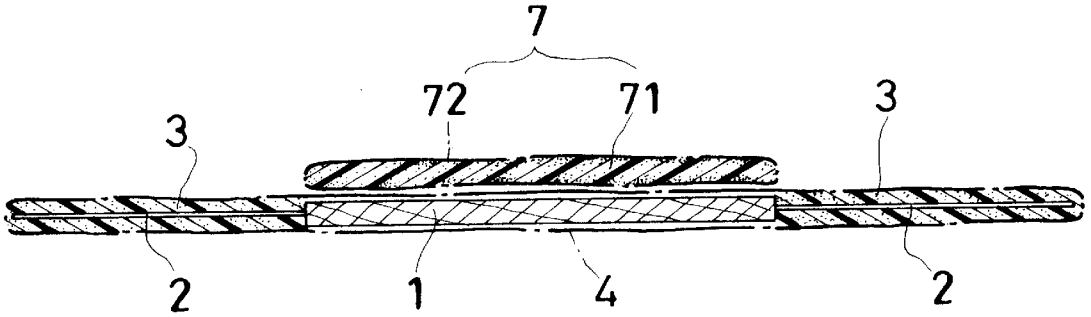
FIG. 2 is a cross-sectional view of the baby pillow of the present invention.
Figure 5:
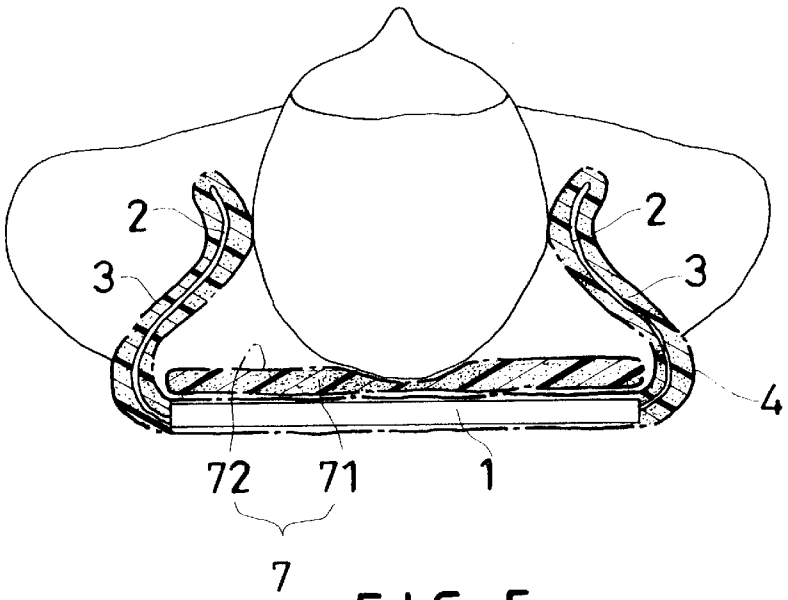
Figure 3:
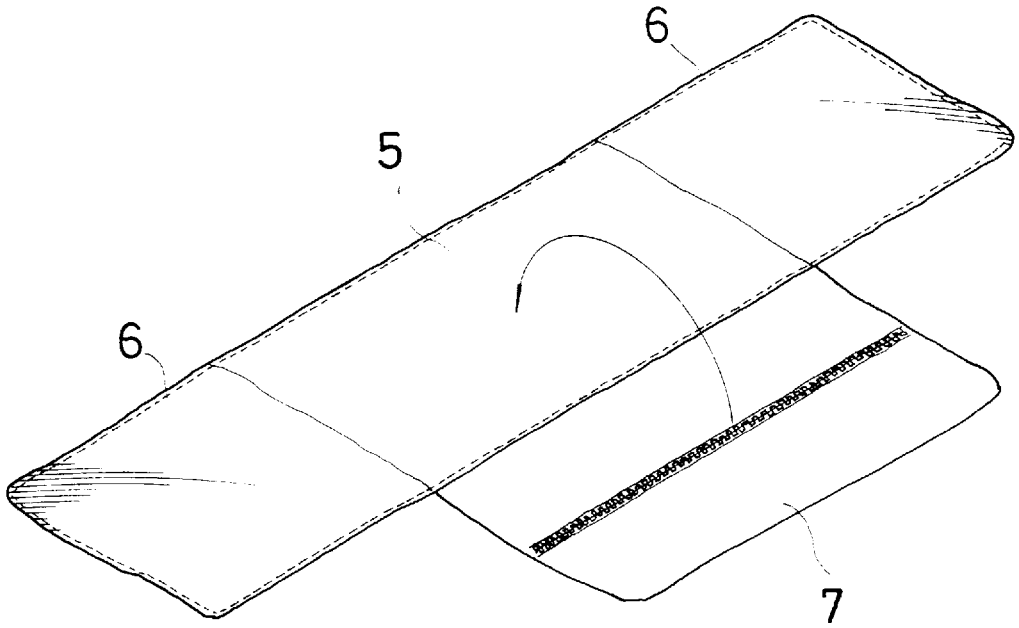
FIG. 3 is a perspective view of the baby pillow with a soft cushion layer sewn to a side of a center pillow portion of the present invention.
Figure 4:
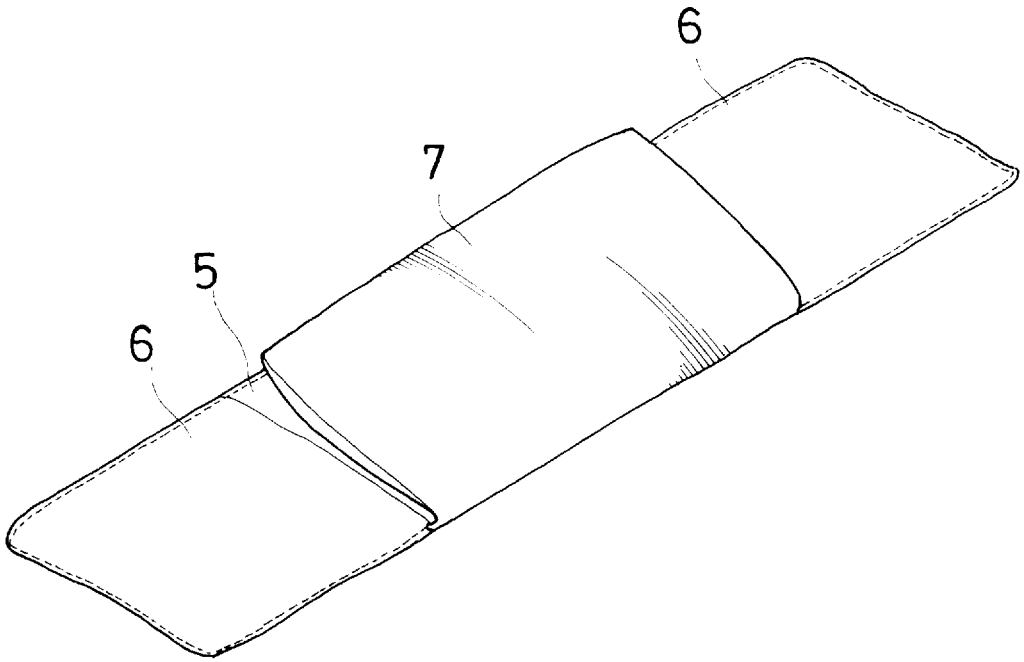
FIG. 4 is a perspective view of the baby pillow with the soft cushion layer folded to overlap the center pillow portion of the present invention; and, FIG. 5 is a side view of a baby's head lying on the soft cushion layer overlapped on the center pillow portion of the present invention, with two side portions folded to a position near the two sides of the baby's head.

A preferred embodiment of the present invention, as shown in FIG. 1, includes a base plate 1 of a proper hardness, two U-shaped side frames 2 made of a plastic pliable material respectively connected to two sides of the base plate 1, a cotton body formed in a space surrounding each of the two side frames 2, a layer of cotton cloth 4 surrounding an upper and a lower surface of both the base plate 1 and the two cotton bodies 3, 3 containing the two frames 2. The base plate 1 becomes a center pillow portion 5 and the two side cotton bodies 3 become a protective portion 6. Then a soft cushion layer 7 is sewn to one side of the cotton cloth of the base plate 1. The soft cushion layer 7 is made of a cotton bag 71 filled with a predetermined volume of cotton 72.

In using the baby pillow of the present invention, firstly the soft cushion layer 7 is folded to overlap the center pillow portion 5, and the head of a baby is laid on the soft cushion layer 7. The two side protective portions 6 are folded up in accordance with the size of the baby's head to contact the two sides of the baby's head, to hamper the baby's head from turning to a side and keeping it in a proper position.

Then, the frames 2, the cotton bodies 3 and the side protective portions 6 form a partition wall located near the ears of the baby, keeping all or some of any ambient noise from reaching the ears of the baby, permitting the baby to sleep soundly.

The baby pillow in the invention has the advantages as follows:

1. The two side cotton bodies with the frames covered with cotton cloth may be folded, limiting movement of a baby's head, keeping it in a proper position, and preventing it from turning to one side.

2. The two side cotton bodies with the frames covered with cotton cloth can be folded up to contact the two ears of a baby to fully or partly block ambient noise from reaching the ears of a baby, permitting the baby to sleep soundly.

While the preferred embodiment of the invention has been described above, it will be recognized and understood that various modifications may be made therein and the appended claims are intended to cover all such modifications which may fall within the spirit and scope of the invention.

What is claimed is:

1. A baby pillow comprising a center base plate, two side frames connected to two sides of said center base plate and formed of a plastic material, two cotton bodies surrounding each said side frame, a cotton cloth layer covering an upper surface and a lower surface of said center base plate and said two side cotton bodies, said two cotton bodies together with said frames forming two protective portions, a soft cushion layer made of a cotton bag filled with cotton and sewn to a lower side of a portion of said cotton cloth layer covering said center base plate, said soft cushion layer being folded to overlap said center base plate, a baby's head being laid on said soft cushion layer, said protective portions being folded upward to be adjacent two sides of a baby's head for keeping it from turning to one side, said protective portions at least partially blocking noise from reaching a baby's ears.

* * * * *